US005961012A

United States Patent [19]

Bucher

[11] Patent Number: 5,961,012

[45] Date of Patent: Oct. 5, 1999

[54] SHOEHORN FOR USE WITH WALKING CANE

[76] Inventor: Vernie Bucher, 21272 Amora, Mission Viejo, Calif. 92692

[21] Appl. No.: 09/137,214

[22] Filed: Aug. 20, 1998

[51] Int. Cl.[6] ..... A47G 25/82

[52] U.S. Cl. ..... 223/119; 223/118

[58] Field of Search ..... 223/111, 118, 223/119, 112, 113

[56] References Cited

U.S. PATENT DOCUMENTS

| | | | |
|---|---|---|---|
| 11,445 | 8/1854 | Schwingrouber | 223/119 |
| 655,417 | 8/1900 | Randall | 223/119 |
| 3,591,226 | 7/1971 | Elmore, Jr. | 249/19 |
| 4,966,316 | 10/1990 | George | 223/119 |
| 5,392,800 | 2/1995 | Sergi | 135/65 |

FOREIGN PATENT DOCUMENTS

| | | | |
|---|---|---|---|
| 743067 | 9/1932 | France | 223/118 |
| 457586 | 3/1928 | Germany | 223/118 |

*Primary Examiner*—Bibhu Mohanty
*Attorney, Agent, or Firm*—Goldstein & Canino

[57] ABSTRACT

A shoehorn for use with a walking cane, comprising a conventionally shaped shoehorn for helping a user in slipping into a shoe, and a combination of resilient clips and a hose clamp fastened to the outside surface of the shoehorn, so that the shoehorn can be releasably secured to the walking cane anywhere along its length. Each of the resilient clips includes a base section and a pair of arms integrally extending therefrom, wherein the pair of arms flex outwardly for introduction of the elongated body of the walking cane and snap fits onto the exterior surfaces of the walking cane as the clip is firmly pushed thereinto. The shoehorn is also employs a hose clamp for providing additional clamping support to maintain the shoehorn in fixed relationship with respect to the walking cane during use. In use, the shoehorn can be secured to the lower end of the walking cane to assist users in the insertion of their feet into shoes without having to bend over and can be subsequently removed from the lower end thereof and secured to the upper end thereof for easy storage and carrying.

2 Claims, 1 Drawing Sheet

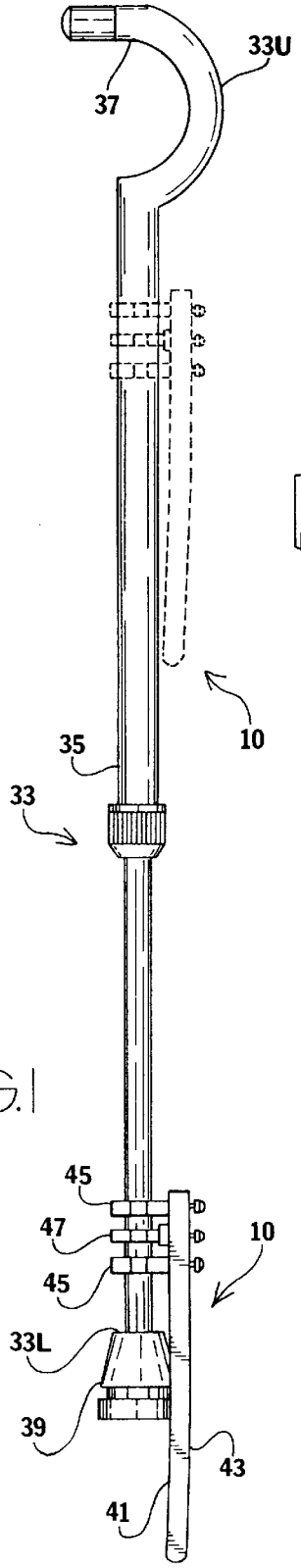
FIG. 1
FIG. 2
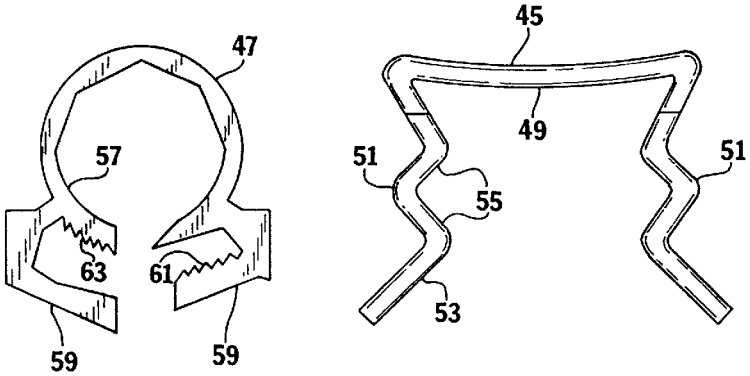
FIG. 3
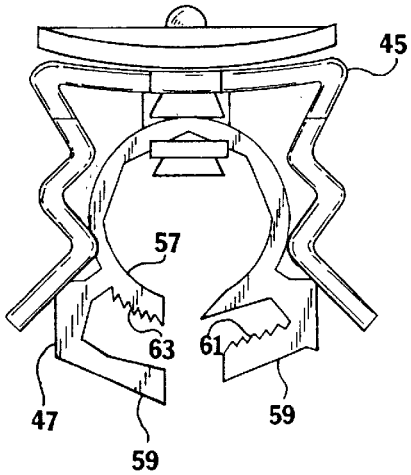

SHOEHORN FOR USE WITH WALKING CANE

BACKGROUND OF THE INVENTION

This invention relates to a shoehorn. More particularly, the invention relates to a shoehorn which has adjustable clips and a utility hose clamp secured to the back side thereof, designed for releasably attaching to the lower end of a walking cane to assist individuals in inserting their feet into shoes without having to stoop.

Several references uncovered in the prior art describe various walking canes combined with additional features. For example, U.S. Pat. No. 5,392,800 to Sergi discloses a multi-purposes cane device provided with a remote object gripping mechanism for enabling a user to perform light work such as retrieving object from the floor and a shoehorn for putting on a shoe without having to stoop. Likewise, U.S. Pat. No. 4,966,316 to George discloses a shoe horn and cane apparatus for securement of a shoe remotely from an individual by clampingly engaging the shoe to enable insertion of an individual's feet therewithin. U.S. Pat. No. 3,591,226 to Elmore discloses another gripping device for handicapped person having a shoehorn attached to one end thereof.

These prior art devices suffer from various disadvantages in that most employ relatively complicating designs and are consequently expensive to manufacture, thereby making them inaccessible for the average consumer. Currently, there is no effective shoehorn that can be used with a conventional style walking cane so that a separate walking cane need not be acquired for those individuals who already have one. Therefore, there is still a further need to provide an improved shoehorn. Such a shoehorn should be simple in construction so as to minimize manufacturing costs and yet capable of being used in conjunction with any conventional style walking cane to help individuals in inserting their feet into shoes without having to bend or stoop. Further, such a shoehorn should be convenient to carry so that it is readily accessible whenever needed.

While these units mentioned above may be suitable for the particular purpose employed, or for general use, they would not be as suitable for the purposes of the present invention as disclosed hereafter.

SUMMARY OF THE INVENTION

It is an object of the invention to provide a shoehorn which is simple in construction so as to minimize manufacturing costs and yet can be effectively used in conjunction with any conventional style walking cane to help individuals in inserting their feet into shoes without having to bend or stoop.

It is another object of the invention to provide a shoehorn which is equipped with a pair of resilient clips for easily and quickly snap fitting onto an elongated body of a walking cane.

It is yet another object of the invention to provide a shoehorn which utilizes a hose clamp fasten to the outside surface of the shoehorn to provide additional clamping support to maintain the shoehorn in fixed relationship with respect to the walking cane during use.

It is a further object of the invention to provide a shoehorn which can be removed subsequent to use and removably attached to the upper end of the walking cane for convenient carrying and storage purposes, so that it is readily accessible whenever needed.

The invention is a shoehorn for use with a walking cane, comprising a conventionally shaped shoehorn for helping a user in slipping into a shoe, and a combination of resilient clips and a hose clamp fastened to the outside surface of the shoehorn, so that the shoehorn can be releasably secured to the walking cane anywhere along its length. Each of the resilient clips includes a base section and a pair of arms integrally extending therefrom, wherein the pair of arms flex outwardly for introduction of the elongated body of the walking cane and snap fits onto the exterior surfaces of the walking cane as the clip is firmly pushed thereinto. The shoehorn is also employs a hose clamp for providing additional clamping support to maintain the shoehorn in fixed relationship with respect to the walking cane during use. In use, the shoehorn can be secured to the lower end of the walking cane to assist users in the insertion of their feet into shoes without having to bend over and can be subsequently removed from the lower end thereof and secured to the upper end thereof for easy storage and carrying.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

FIG. 1 is a diagrammatic perspective view of a preferred embodiment of a shoehorn in accordance with the principles of the present invention, illustrating the shoehorn releasably attached to a walking cane.

FIG. 2 is a plan view of a hose clamp and a resilient clip of the present invention.

FIG. 3 is a top plan view of the shoehorn with the hose clamp and the resilient clip fastened thereto.

DETAILED DESCRIPTION OF THE PREFERRED EMBODIMENTS

FIG. 1 illustrates a preferred embodiment of a shoehorn 10 in accordance with the principles of the present invention. For better understanding of the present invention, a conventional walking cane 33 is illustrated having an elongated body 35 with an upper end 33U terminating in a handle 37 and an opposite lower end 33L covered with a tip cushion 39. As will be seen in the following paragraphs, the shoehorn 10 of the present invention is designed for releasably attaching to the lower end 33L of a walking cane 33 to help individuals in inserting their feet into shoes without having to bend or stoop.

The shoehorn 10 can be of any conventional shape useful in helping a user slip into a shoe and presents an inside surface 41 for direction toward a heel of a user and an outside surface 43 for direction away from the user. One aspect of importance in the present invention is the ability to releasably secure itself to anywhere along the length of the walking cane 33. The means for releasably securing the shoehorn 10 to the walking cane 33 may be carried out in a number of ways. As seen by referring to FIGS. 2 and 3, in the preferred embodiment, the present invention utilizes a combination of a pair of resilient clips 45 and a hose clamp 47 to securely fasten about a walking cane. The resilient clips 45 and hose clamp 47 can be fastened to the shoehorn 10 by means of bolts and nuts, or by any other fastening means as would be appreciated by those skilled in the art.

The resilient clip 45 of the present invention includes a base section 49 and a pair of arms 51 integrally extending therefrom arranged for snap fitting onto the elongated body 35 of the walking cane 33. The resilient clip 45 is constructed in such manner as to permit the pair of arms 51 to flex outwardly for the introduction of walking cane and to automatically press inwardly against the exterior surfaces of the walking cane, as the clip is firmly fitted into the walking cane. Each of the arms 51 is defined in part by an end section 53 bent outward for easily receiving the elongated body of the walking cane and a middle bent section 55 to embrace the exterior surfaces of the walking cane when the shoehorn is secure thereto.

The shoehorn 10 is also provided with the hose clamp 47 constructed of plastic material for providing additional clamping support to maintain the shoehorn 10 in fixed relationship with respect to the walking cane 33 during use. The hose clamp 47 includes an open ended circular portion 57 having an interior surface configured to engage around the circumference of the walking cane and a pair of inwardly projecting clamp portions 59 integrally connected to the exterior surface of the circular portion for interlocking with each other. One of the inwardly projecting clamp portions 59 is provided with a first set of teeth 61 for releasably fastening to a second set of teeth 63 carried along the exterior surface of the circular portion 57.

The operation of the shoehorn 10 of the present invention will now be described. The shoehorn can be attached to the lower end 33L of the walking cane 33 by snap fitting the resilient clips 45 about the exterior circumference thereof and tightening the hose clamp 47 thereabout by locking the inwardly projecting clamping portions 59 together. In this manner, the shoehorn 10 serves to assist users in the insertion of their feet into shoes without having to bend over. The shoehorn 10 can be subsequently removed from the lower end 33L of the cane by unlocking the inwardly projecting clamping portions 59 of the hose clamp 47 and attached near the upper end 33U of the walking cane for convenient carrying and storage purposes, so that it is readily accessible whenever needed.

While the embodiments of the present invention are disclosed in relation to the shoehorn being used with a walking cane, it will be appreciated by those skilled in the art that the shoehorn disclosed herein can be easily modified for use with other elongated objects. Many specific details contained in the above description merely illustrate some preferred embodiments and should not be construed as a limitation on the scope of the invention. Many other variations are possible.

What is claimed is:

1. A shoehorn comprising:

a) a shoehorn of a conventional shape to assist a user in slipping into a shoe which includes an inside surface for direction toward a heel of the user and an outside surface for direction away from the user; and b) securing means, comprising at least one resilient clip fastened to the outside surface of the shoehorn, said resilient clip having a base section and a pair of arms integrally extending therefrom, wherein said pair of arms have an end section bent outwardly in order to fastened to said outside surface of said shoehorn, and a middle bend section adapted to embrace an exterior surface of the elongated object when the shoehorn is secure thereto and snap fits onto an elongated object as the clip is firmly pushed into a walking cane, wherein the shoehorn can be secured about one end thereof to help users in inserting their feet into shoes without having to stoop;

c) securing means further comprising a hose clamp fastened to the outside surface of the shoehorn for providing additional clamping support to maintain the shoehorn in fixed relationship with respect to the elongated object during use, said hose clamp including an open ended circular portion having an interior surface configured to engage around the circumference of the elongated object and a pair of inwardly projecting clamp portions integrally connected to an exterior surface of the circular portion configured for interlocking with each other, wherein one of the inwardly projecting clamp portions is provided with a first set of teeth for releasably fastening to a second set of teeth carried along the exterior surface of the circular portion.

2. A shoehorn for use with a walking cane having an elongated body which includes opposite upper and lower ends, comprising:

a) a shoehorn of a conventional shape to assist a user in slipping into a shoe which includes an inside surface for direction toward a heel of the user and an outside surface for direction away from the user; and b) securing means, comprising at least one resilient clip fastened to the outside surface of the shoehorn, said resilient clip having a base section and a pair of arms integrally extending therefrom, wherein said pair of arms have an end section bent outwardly for easily receiving the elongated body of the walking cane, and a middle bend section adapted to embrace an exterior surface of the walking cane when the shoehorn is secured thereof, wherein the securing means snap fits onto the elongated body of the walking cane as the clip is firmly pushed into the walking cane, thereby allowing the shoehorn to be secured about the lower end thereof to help users in inserting their feet into shoes without having to stoop;

c) securing means further comprising a hose clamp fastened to the outside surface of the shoehorn for providing additional clamping support to maintain the shoehorn in fixed relationship with respect to the walking cane during use, said hose clamp including an open ended circular portion having an interior surface configured to engage around the circumference of the walking cane and a pair of inwardly projecting clamp portions integrally connected to an exterior surface of the circular portion configured for interlocking with each other, wherein one of the inwardly projecting clamp portions is provided with a first set of teeth for releasably fastening to a second set of teeth carried along the exterior surface of the circular portion.

* * * * *